US006224056B1

(12) United States Patent
Jones

(10) Patent No.: US 6,224,056 B1
(45) Date of Patent: May 1, 2001

(54) EDUCATIONAL BOARD GAME AND METHOD FOR TEACHING OCCUPATIONAL SKILLS

(75) Inventor: Christopher D. Jones, Sterling, VA (US)

(73) Assignee: Media Works, LLC, Falls Church, VA (US)

( * ) Notice: Subject to any disclaimer, the term of this patent is extended or adjusted under 35 U.S.C. 154(b) by 0 days.

(21) Appl. No.: 09/471,715

(22) Filed: Dec. 23, 1999

(51) Int. Cl.[7] ..... A63F 3/00
(52) U.S. Cl. ..... 273/249; 273/262; 273/431
(58) Field of Search ..... 273/262, 236, 273/242, 243, 248, 249, 430, 431

(56) References Cited

U.S. PATENT DOCUMENTS

| | | | | |
|---|---|---|---|---|
| 4,030,762 | * | 6/1977 | Gilmore | 273/134 |
| 4,089,527 | * | 5/1978 | Roth | 273/249 |
| 4,280,704 | | 7/1981 | Massimei et al. | 273/258 |
| 4,480,837 | * | 11/1984 | Poirier | 273/252 |
| 4,570,939 | | 2/1986 | Tourville et al. | 273/253 |
| 4,572,514 | | 2/1986 | Aponte | 273/255 |
| 4,900,032 | * | 2/1990 | Erickson et al. | 273/243 |
| 4,902,017 | | 2/1990 | Grammatico | 273/240 |
| 5,009,430 | | 4/1991 | Yuhasz | 273/255 |
| 5,118,115 | | 6/1992 | Codinha | 273/255 |
| 5,150,908 | | 9/1992 | Codinha | 273/262 |
| 5,360,216 | * | 11/1994 | Counterman | 273/243 |
| 5,454,569 | | 10/1995 | Walker | 273/236 |
| 5,704,611 | * | 1/1998 | Pierce | 273/243 |
| 5,816,819 | * | 10/1998 | Rockburn | 434/106 |

* cited by examiner

*Primary Examiner*—Stephen F. Gerrity
*Assistant Examiner*—Zelalem Eshete
(74) *Attorney, Agent, or Firm*—Rossi & Associates

(57) ABSTRACT

An educational board game and method for teaching occupational skills that conveys relevant occupational education information to a user in an interesting and entertaining manner, thereby encouraging the user to utilize the board game and method on a regular basis to reinforce basic training information and learn new training information. More specifically, the invention comprises an educational board game, wherein players progress for correctly answering questions from various categories of a selected occupational education subject matter, that includes: a game board having a playing surface that includes a center portion representing a goal to be achieved, a boundary area surrounding the center portion and comprising a plurality of starting point spaces, each space bearing a visual indicator, and a plurality of movement spaces interspersed between the starting point spaces, each movement space bearing a visual indicator of an occupational education subject category, and spoke areas connecting the center space with the boundary area and comprising further movement spaces; a plurality of individual game pieces, each game piece bearing a visual indicator corresponding to a starting point space; a plurality of question and answer cards, each card bearing a visual indicator corresponding to one or more movement spaces; a plurality of penalty cards; a chance means for determining movement along the boundary area and spoke area; and a plurality of tokens to be awarded as each game piece reaches a starting point space.

20 Claims, 8 Drawing Sheets

EDUCATIONAL BOARD GAME AND METHOD FOR TEACHING OCCUPATIONAL SKILLS

FIELD OF THE INVENTION

The present invention relates to a game playable on a board and, more particularly, to an educational board game and method for teaching occupational skills.

BACKGROUND OF THE INVENTION

It has become increasingly difficult to maintain occupational skills at an appropriate level in today's world of complex technology. Maintaining a sufficient skill level among staff members, employees or volunteers is particularly difficult in situations in which the individual is not employed full time in the occupation in question. A typical example is the case of a volunteer fireman or member of a National Guard organization whose training is primarily conducted in short sessions separated by long periods of inactivity. In order to maintain readiness and keep occupational skills at an acceptable level, it would be desirable to provide a training device that would reinforce information learned in formal training sessions.

In order for a training device to be effective, it must be capable of capturing and holding the attention of the user, while at the same time conveying necessary information to the user in a manner in which it will be readily retained. For example, training manuals and video tapes, while containing all of the relevant information required by the user, generally do not generate sufficient interest to hold the attention of the user in a manner that insures relevant information will be retained. Accordingly, while one can require an individual to read a manual, listen to a tape or watch a video, it is questionable as to whether a sufficient amount of relevant information is ultimately transferred from these training materials to the individual required to perform the described tasks. Accordingly, it would be highly desirable to provide a training device that not only conveys the necessary information, but does so in a manner that an individual finds interesting and entertaining, so the individual will be interested in using the training device on a regular basis and will be more likely to retain relevant information conveyed by the training device.

SUMMARY OF THE INVENTION

The invention provides an educational board game and method for teaching occupational skills that conveys relevant occupational education information to a user in an interesting and entertaining manner, thereby encouraging the user to utilize the board game and method on a regular basis to reinforce basic training information and learn new training information.

More specifically, the invention comprises an educational board game, wherein players progress for correctly answering questions from various categories of a selected occupational education subject matter, that includes:

- a game board having a playing surface that includes a center portion representing a goal to be achieved, a boundary area surrounding the center portion and comprising a plurality of starting point spaces, each space bearing a visual indicator, and a plurality of movement spaces interspersed between the starting point spaces, each movement space bearing a visual indicator of an occupational education subject category, and spoke areas connecting the center space with the boundary area and comprising further movement spaces;

- a plurality of individual game pieces, each game piece bearing a visual indicator corresponding to a starting point space;
- a plurality of question and answer cards, each card bearing a visual indicator corresponding to one or more movement spaces;
- a plurality of penalty cards;
- a chance means for determining movement along the boundary area and spoke area; and a plurality of tokens to be awarded as each game piece reaches a starting point space.

In a particularly preferred embodiment of the invention, a method for playing an educational board game includes having a first player select a game piece and place it upon a starting point, activating the chance means to indicate the number of spaces said first player is to advance said game piece along the boundary area in any direction from the starting space, advancing the game piece the number of spaces indicated by said chance means to a movement space, selecting a question and answer card bearing a corresponding visual indicator to that of the movement space and asking the first player the question thereon, timing the first player while he or she answers said question, allowing the first player to play again if he or she answers correctly within a pre-selected time period or, if he or she answers incorrectly, passing the chance means to the next player, unless the question card is marked as critical, wherein said first player is required to draw a penalty card and to perform the penalty described thereon before passing the chance means to the next player, continuing play through all players until at least one player has visited each starting point space, collected a token from each, and progressed along a spoke area to enter the central area where a final question, chosen by the other players, is answered.

Additional features, objects and advantages of the invention will become apparent from the following detailed description of the preferred embodiments of the invention and the accompanying drawings.

BRIEF DESCRIPTION OF THE DRAWINGS

The invention will be described with reference to certain preferred embodiments thereof along with the accompanying drawings, wherein.

DETAILED DESCRIPTION OF THE PREFERRED EMBODIMENTS OF THE INVENTION

The invention will be described with reference to a preferred embodiment of the invention in which military occupational education information is conveyed to the user. It will be understood, however, that the invention is not limited to military education subject matter, but instead, can be employed as a training device for any desired type of occupational education subject matter.

Figure 1:
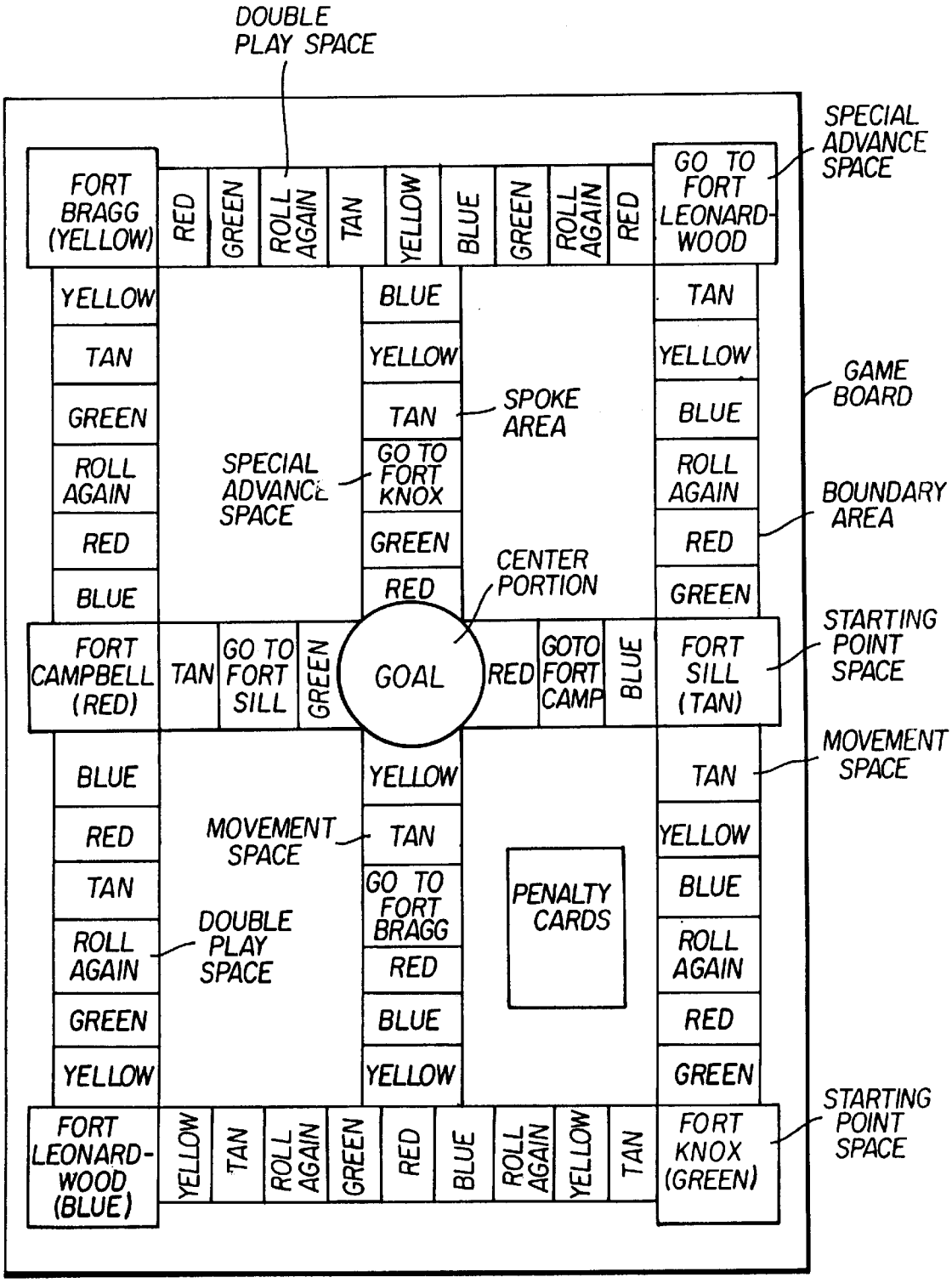
FIG. 1 is a top elevational view of the game board of the present invention.

A military educational board game in accordance with the invention is illustrated in FIG. 1 as including a game board which is flat. The game board is preferably rectangular in shape, although other shapes, such as circular, ovoid or triangular could also be used so long as the shape selected contains a distinct center portion surrounded by a boundary area, with one or more spokes connecting the center portion with the boundary area.

The surrounding boundary area and spoke areas comprise both starting point spaces and movement spaces interspersed between the starting point spaces. Each of the starting point spaces bears a visual indicator, which in the illustrated preferred embodiment is a geographic area such as the names of military installations or forts. For example, the following starting point spaces may be found at a corner of the boundary area or may occur within continuous portions of the boundary area, as seen in FIG. 1:

Fort Bragg in the upper left hand corner of FIG. 1, color coded yellow;

Fort Campbell to the left of the center portion of FIG. 1, color coded red;

Fort Leonardwood in the lower left hand corner of FIG. 1, color coded blue;

Fort Knox in the lower right hand corner of FIG. 1, color coded green; and

Fort Sill to the right of the center portion of FIG. 1, color coded tan.

The apparatus of the game also includes a plurality of individual game pieces, each game piece bearing a visual indicator of a geographic area corresponding to a starting point space. The game piece can be of any desired shape or configuration. For example, a yellow truck-shaped game piece would take Fort Bragg (yellow) as its starting point.

Figure 2:
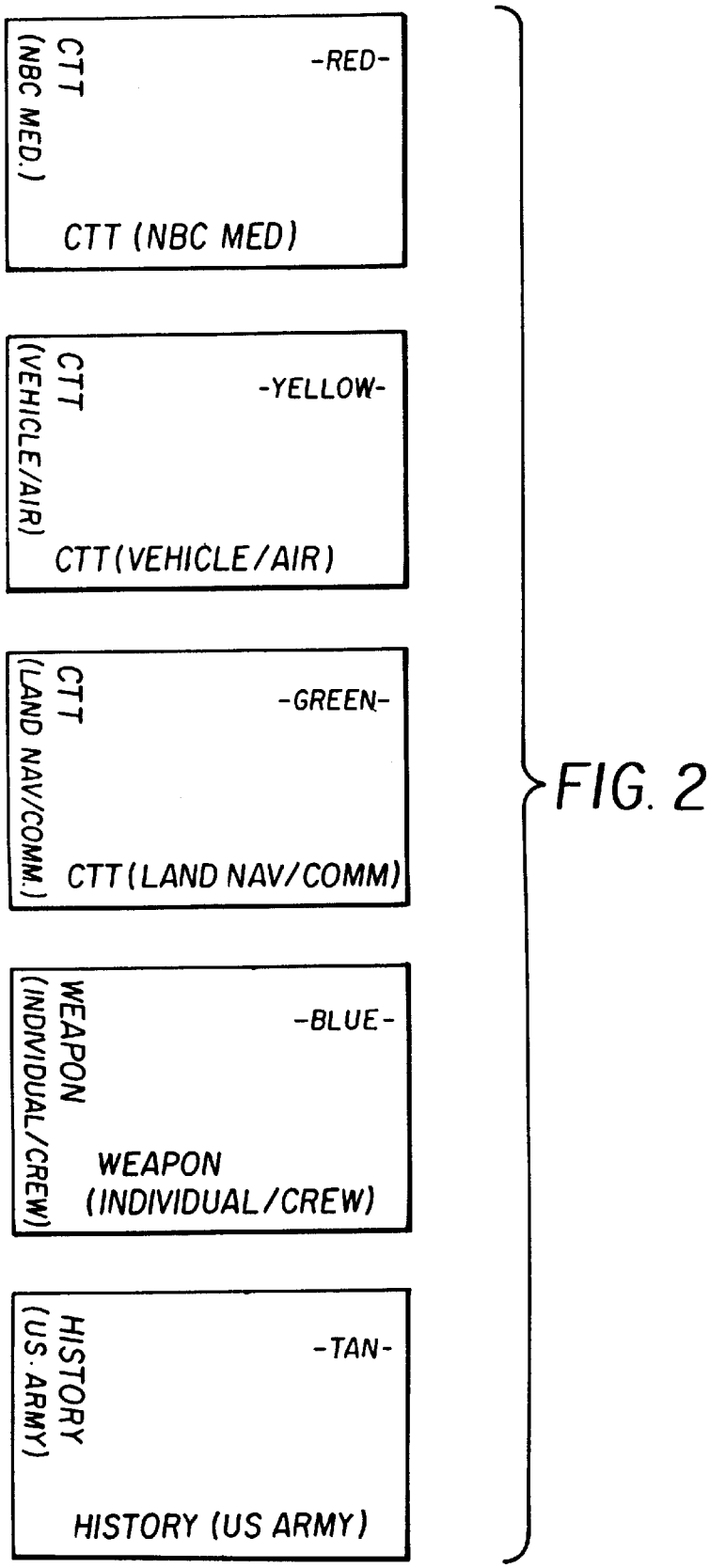
FIG. 2 is a top elevational view of five decks of question and answer cards, each deck being color coded to correspond to a particular military subject category.

The movement spaces on the game board, which are interspersed between the geographical starting point spaces, bear a visual indicator of a military subject category, such as by color coding, distinctive design, or other such difference in appearance. The number of subject categories is limited only by the number of players or the size of the game board. For example, in a preferred embodiment, as shown in FIG. 2, there are five categories of questions, with each being identified by a distinct color as follows:

| | |
|---|---|
| Red | CTT (NBC/Medical) |
| Yellow | CTT (Vehicle/Aircraft Identification) |
| Green | CTT (Land Navigation/Communications) |
| Blue | Weapon (Individual/Crew served) |
| Tan | History (U.S. Army) |

The apparatus also includes a chance means for determining movement along the boundary area and spoke area, a plurality of penalty cards for incorrect answers to certain questions, and a plurality of tokens to be awarded as each game piece reaches one of the starting point spaces.

The number of players or teams is limited only by the number of starting point spaces. Preferably, there are two or more players, more preferably between two and ten, most preferably from three to five players or teams.

In order to start play, each player or team selects a playing piece and places it on the starting point square of the same distinctive appearance, e.g., placing a yellow token on the yellow starting point space designated "Fort Bragg." The identity of the first player determined by lots, by use of the chance means included in the apparatus of the invention, or any other method to be agreed upon by the players. The chance means may be any one of a variety of known chance means, such as dice, a spinning dial, drawing numbers out of a hat or sack-like receptacle, an automated lottery device, or by simply repeating the flipping of one or more coins.

Preferably, however, the chance means is a single die, and to determine which player goes first in the game, each player or team rolls a single die one at a time. The player rolling the highest number starts the game. If two or more players roll the same highest number, those players follow typical procedures to resolve the tie. For example, those players, and only those players, may keep rolling the die an equal number of times until one player wins the starting turn. When it has been determined which player to is to be the first player, he or she then activates the chance means of the game, for example, by throwing a single die.

The player then moves the exact number of squares indicated by the chance device, no more and no less. When a single die is used as the chance device, the usual practices of employing dice are used. For example, if a die lands on an uneven surface and, as a result, is cocked, it is not counted and must be rolled again to exhibit an unambiguous upper surface. Movement of a game piece in a single turn must be in one direction only, but can follow any path on the boundary, spoke, or central area. For example, in the preferred embodiment shown in FIG. 1, a game piece on the Fort Sill square can move on the path to the right along the boundary area toward Fort Leonardwood, to the left toward Fort Campbell, or straight ahead across the spoke area, including the central portion ("goal"), to reach Fort Knox.

Figure 3:
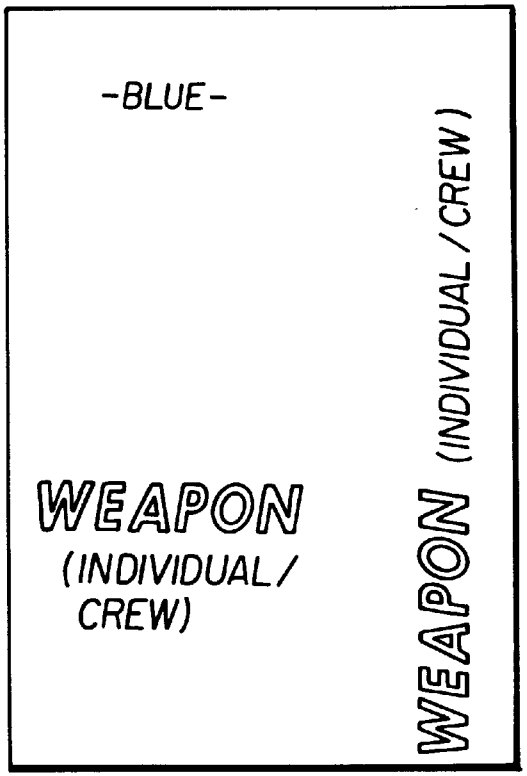
FIG. 3 is a top elevation view of one deck of question and answer cards, which are color coded to correspond to the subject "Weapon (Individual/Crew)."
Figure 4A:
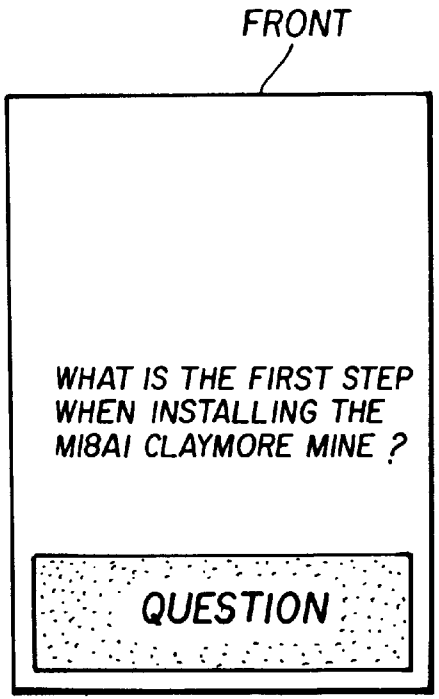
FIGS. 4A and 4B show the front and back of a question and answer card.
Figure 4B:
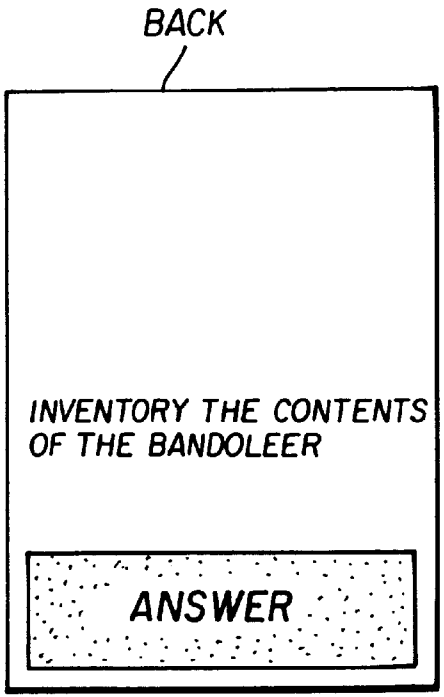
Figure 5A:
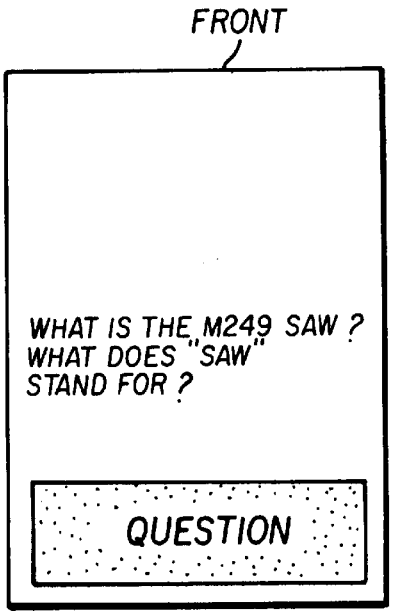
FIGS. 5A and 5B show the front and back of a question and answer card.
Figure 5B:
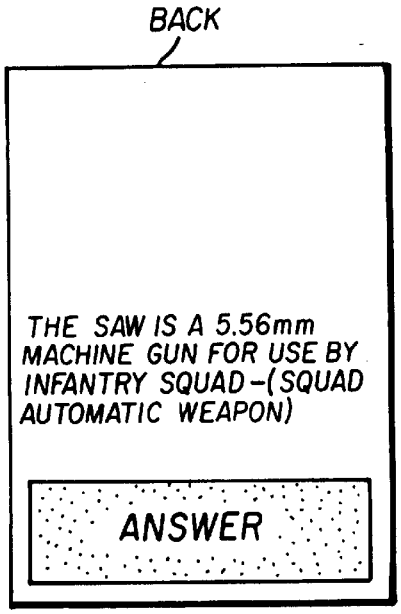

If the first player lands on a movement space, the player to the left of the first player takes a question and answer card from the top of the deck bearing the same visual designation as the movement space the first player has landed upon. For example, when the visual designation is the color coding of the preferred embodiment, if the first player has landed on a blue movement space, the player to his left selects a question and answer card from the blue-colored deck, i.e., a question and answer card dealing with a "Weapon", as shown in FIG. 3.

The person to the left of the first player reads the question to the first player and times the response of the first playing, allowing him or her a pre-selected time period in which to answer correctly. The pre-selected time may vary depending upon the skill of the players and the relative difficulty of the questions. However, preferably, the time period allowed is about one minute. At the end of the pre-selected time, the player to the left of the first player turns over the question and answer card to determine if the first player has answered correctly within that time. If the first player answers the question correctly, he or she is allowed to take another turn. If not, the turn ends.

In a preferred embodiment, each deck of cards is bound by a book binding screw or binder at one corner thereof, thereby preventing the possibility of loss of cards if the card deck is dropped. The book binding screw can be removeable to allow for the shuffling of the card deck if desired.

Because the questions are read aloud and then answered afterward, the game serves not only as a test of acquired knowledge, but as an effective study tool. The game aids retention of facts through repetition and competition. Soldiers read questions, answer questions, and discuss the answer afterwards. Everyone learns during the process.

Figure 6A:
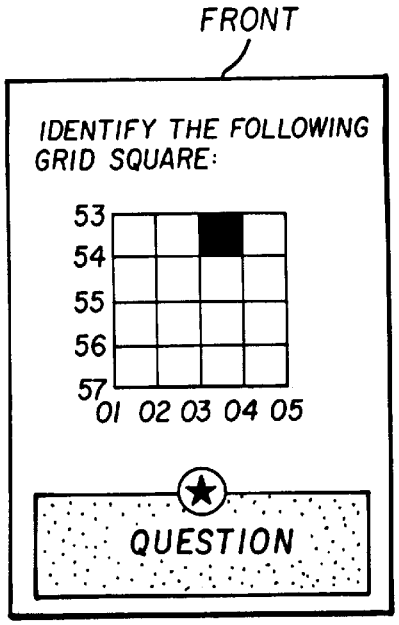
FIGS. 6A and 6B show the front and back of a question and answer card.
Figure 6B:
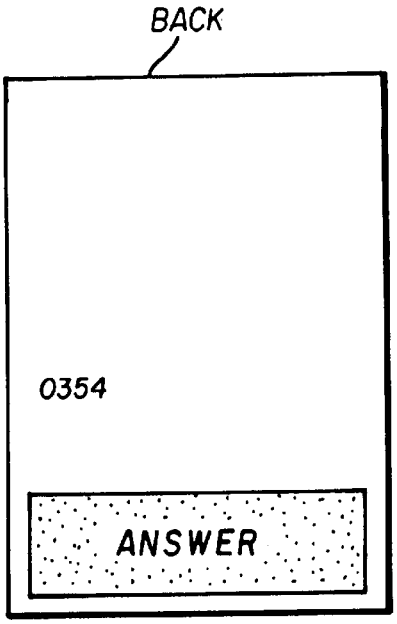
Figure 7A:
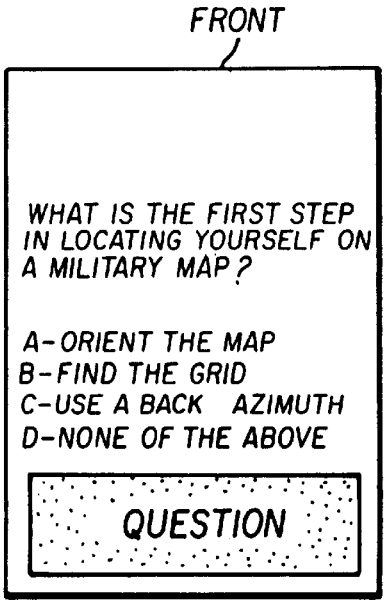
FIGS. 7A and 7B show the front and back of a question and answer card.
Figure 7B:
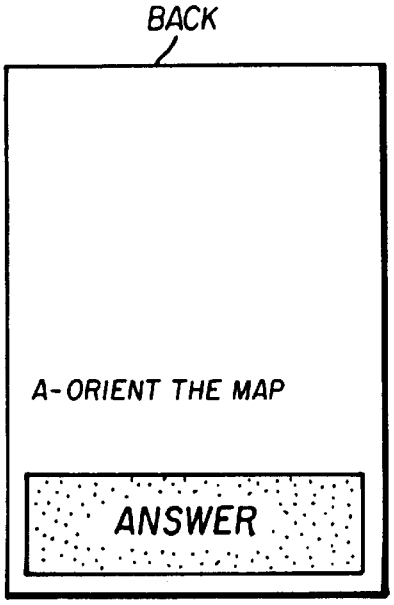
Figure 8A:
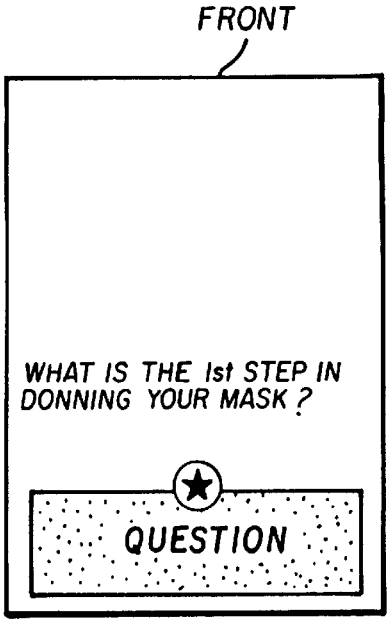
FIGS. 8A and 8B show the front and back of a question and answer card.
Figure 8B:
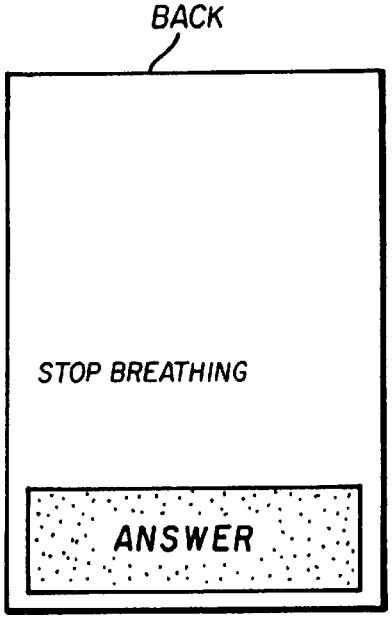
Figure 9A:
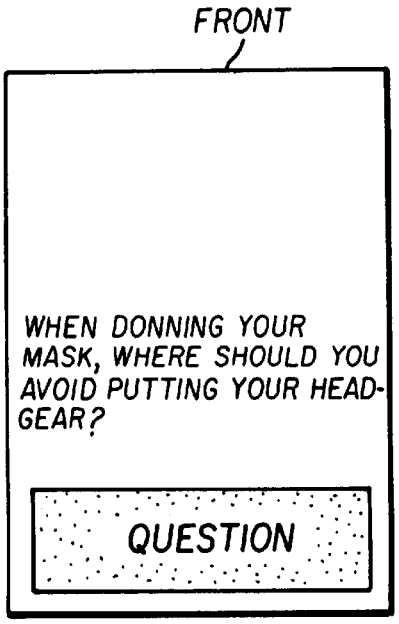
FIGS. 9A and 9B show the front and back of a question and answer card.
Figure 9B:
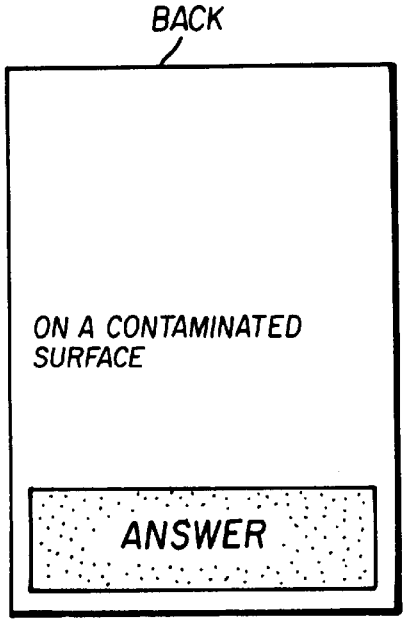
Figure 10A:
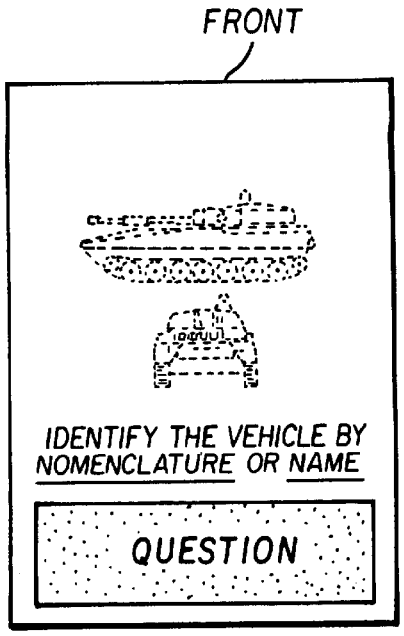
FIGS. 10A and 10B show the front and back of a question and answer card.
Figure 10B:
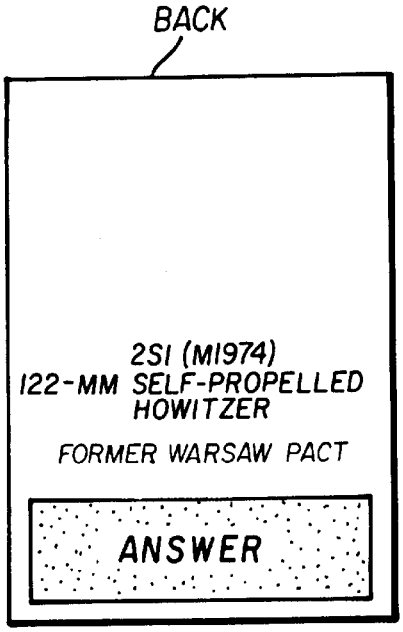
Figure 11A:
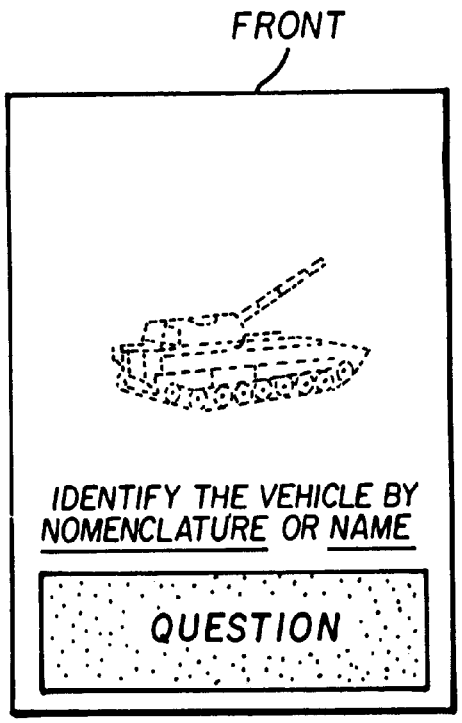
FIGS. 11A and 11B show the front and back of a question and answer card.
Figure 11B:
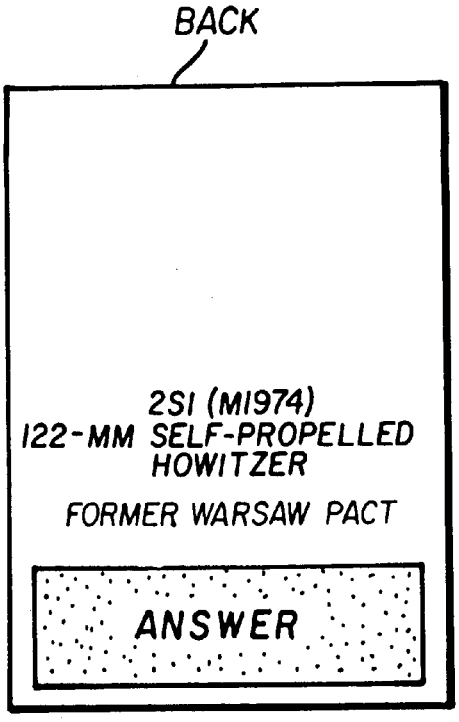
Figure 12A:
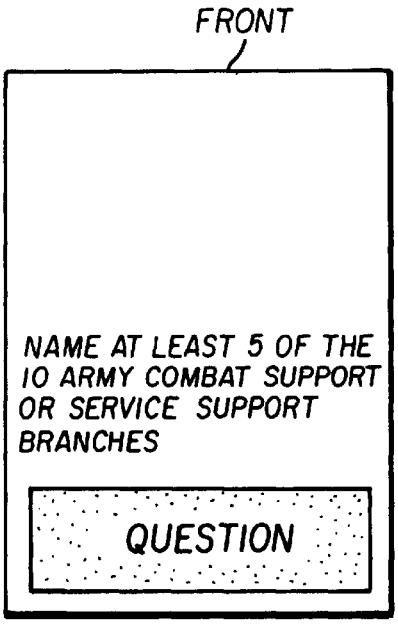
FIGS. 12A and 12B show the front and back of a question and answer card.
Figure 12B:
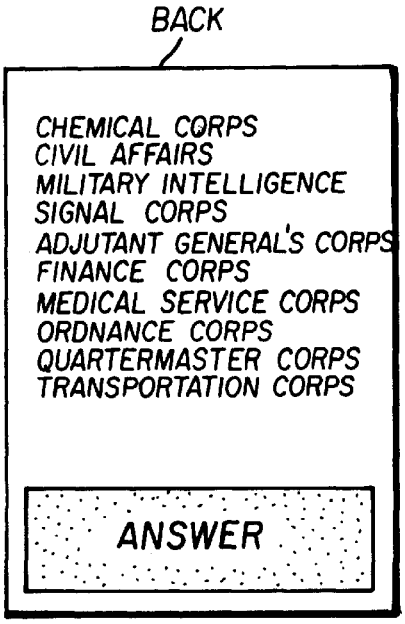
Figure 13A:
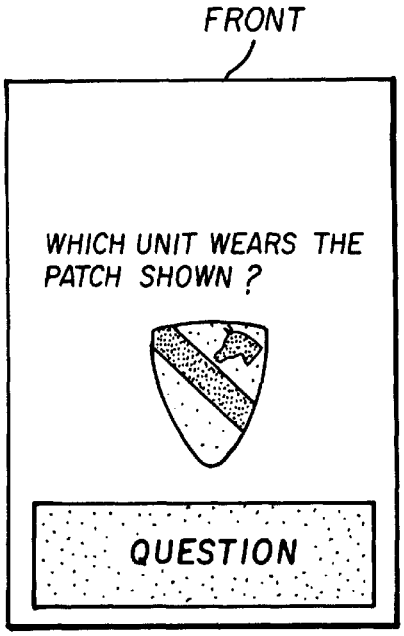
FIGS. 13A and 13B show the front and back of a question and answer card.
Figure 13B:
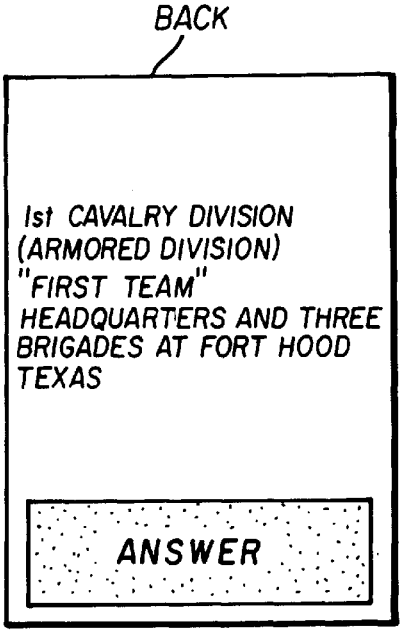

If a question is marked as special, for example, by a star or an asterisk as shown in FIGS. 6A and 8A, or by differences in type style, shading, underlining, capitalizing, etc., it is considered to be mission critical or potentially life threatening. If a player fails to answer correctly such a question within the pre-selected time period, he or she is penalized. The player must immediately take a penalty card from the top of an appropriate deck of penalty cards, which may be placed directly on the game board in a designated space as shown on the game board of FIG. 1.

The player must then perform whatever penalty is described, for example, a physical exercise, such as a prescribed number of flutter kicks, abdominal crunches or diamond pushups; an exercise requiring some degree of mental acuity, such as the recital of thc previous day's lunch or dinner menu from memory; or an exercise of physical coordination, such as having to hop on one foot for 30 times. Once the penalty has been performed, the penalty card is returned to the bottom of the deck of penalty cards.

If a player ends its movement in the center portion of the game board, indicated "goal" in FIG. 1, the other players together determine the subject category from which a question and answer card will be selected for the player, preferably indicated by a particular color. However, the other players are not allowed to determine what the next question for each category is before selecting a particular subject category.

If any player ends his or her movement on the starting point space, and answers a question of the appropriate category correctly, he or she collects a token for the accomplishment. The token can be any convenient token that acts as an indicator of landing on that space and answering correctly a question of that category. For example, tokens may be nuggets, small hats, diamond-shaped, an appropriately colored string or cord—any object that will denote passage at that particular starting space. Preferably, as in the game board of FIG. 1, if a player lands on a "Fort Bragg" starting space (yellow in color) and answers correctly a "yellow" question (pertaining to Vehicle/Aircraft Identification), he or she would receive a yellow color-coded token to evidence a successful visit to "Fort Bragg." Most preferably, the token is in the form of a colored ring that can be conveniently placed atop or around the game-piece used by each player or team.

To win the game, a player must (1) obtain a token from each of the other starting point spaces, e.g., each military fort on the game board and then (2) proceed along one of the spoke areas to land on the central portion, indicated "goal" in FIG. 1, and (3) answer a question at the goal that is selected by the other players as outlined above.

In a preferred embodiment, the game board comprises a plurality of double play spaces interspersed among the starting point spaces and the movement spaces, preferably in the boundary area. When double play spaces are present, they are visually marked with an appropriate logo, such as "Roll Again", "Take Another Turn", "Repeat Turn" or the like. If the first player's game piece ends its movement on a double play space, rather than a movement space, the first player's turn continues without having to answer a question correctly, and he or she once again activates the chance means to initiate movement of his or her game piece on the game board.

Further, in a preferred embodiment, the game board also comprises a plurality of special advance spaces interspersed among the starting point spaces and the movement spaces in either the boundary area or the spoke area(s). When special advance spaces are present, they are visually marked with an appropriate logo, typically instructing the player "Go To" one of the starting point spaces. Specifically, in the preferred embodiment shown in FIG. 1, the special advance space instructs the player's game piece that lands upon it to go directly to Fort Bragg, Fort Campbell, Fort Leonardwood, Fort Knox or Fort Sill. This may be to the player's advantage if his or her game piece is instructed to directly "go to" one of the Fort starting point spaces for the first time, allowing him or her to answer an appropriate question and collect a token to evidence the successful visit. However, if the player has already visited the Fort and collected such a token, this may impede his progress toward the goal of also collecting a token from each of the remaining starting point "Fort" spaces on the game board.

If a game piece ends its movement on such a special advance space and is moved to the indicated square without having to answer a question. However, once there, the player to the left asks the player of the game piece a question from a question and answer card corresponding the subject matter indicated on the landed upon space. In the preferred embodiment, for example, if a game piece is sent to Fort Bragg by a special advance space, a yellow question and answer card will be used to question the player. The player must then answer the question correctly within the pre-selected time period to continue his or her turn.

When a player has collected all of tokens, one from each of the five starting point spaces, the player should seek to move his or her game piece to the "goal" in the center portion of the game board. To reach the center potion, the piece must complete its movement there, moving the exact number of squares—no more and no less—shown on the chance means, e.g., the top of a single die. If, upon reaching the center portion, a player can also answer a question from the category selected by the other players, that player wins. While the winning by a single player or team usually ends the game, the remaining players may wish to continue play to establish a runner-up, third place, and so on until all or nearly all players have collected each required token and progressed to the center portion of the game board.

The military board game of the invention offers an innovative approach to training and development that is fun and interesting to the present-day soldier. Soldiers easily learn MOS, branch information, and common tasks, and the game can be played in any location, even in the field. The unsupervised, informal instruction of the game is user friendly and engaging. Moreover, the self-generating competition engendered by the game induces learning, and peer pressure adds the elements of motivation and intensity.

The game is also capable of being customized to any military specialty, enabling soldiers to learn facts, figures, visual recognition, and any other skills requiring memorization. Further, the game is an affordable and effective method of enabling soldiers to learn important information on their own time and of their own initiative, thereby drastically cutting training costs.

Further still, the effectiveness of the game has actually been demonstrated. Recently, the West Virginia National Guard, 201st Field Artillery, B Battery, took the game of the invention into the field for three weeks of training. The unit's commander reported not only daily use, but enthusiastic and competitive use of the game.

Although the present invention has been described in some detail for purposes of clarity and understanding, it is understood that certain changes and modifications not illustrated above may be made within the spirit of the invention. For example, visual indicators other than color coding, including graphic characters, pictures or icons, may readily be employed as the visual indicators. The scope of this invention is therefore to be limited solely by the appended claims.

What is claimed is:

1. An educational board game, wherein players progress for correctly answering questions, said game comprising:

a. a game board having a playing surface and comprising:
  1) a center portion representing a goal to be achieved;
  2) a boundary area surrounding said center portion and comprising a plurality of:
    a) starting point spaces, each starting point space having a unique visual indicator; and
    b) movement spaces interspersed between said starting point spaces, each movement space bearing a visual indicator of an occupational education subject category; and
  3) at least one spoke area connecting said center space with said boundary area and comprising further movement spaces;

b. a plurality of individual game pieces, each game piece bearing a visual indicator that corresponds to the visual indicator of one of the starting point spaces;

c. a plurality of question and answer cards, each card bearing a visual indicator of an occupational education subject category corresponding to the visual indicator of one or more movement spaces;

d. a plurality of penalty cards;

e. a chance means for determining movement along said boundary area and spoke area; and f. a plurality of tokens to be awarded as each game piece reaches a starting point space.

2. The board game of claim 1 wherein the center portion is circular, the boundary area is rectangular, and the spoke area connect the center area with either a starting point space or a movement space in the boundary area.

3. The board game of claim 1 wherein each starting point space bears a visual indicator of a military fort in the United States of America.

4. The board game of claim 1 wherein at least one of said visual indicators of said starting point spaces and said visual indicators of said moving spaces are color coded.

5. The board game of claim 1 wherein said boundary area also comprises a plurality of double play spaces interspersed among said starting point spaces and said movement spaces.

6. The board game of claim 1 wherein said spoke area or boundary area comprises a special advance space, which indicates that a progressing game piece should "go to" a specified starting point space.

7. The board game of claim 1 wherein said question and answer cards bear a question regarding an aspect of military information relating to the corresponding occupational education subject category and the answer to the question.

8. The board game of claim 1 wherein said game board further comprises an area for the placement of penalty cards.

9. The board game of claim 1 wherein said penalty cards indicate various penalties for incorrect answers to questions on said question and answer cards.

10. The board game of claim 1 wherein said chance means is a die.

11. A method for playing an educational board game, wherein players progress for correctly answering questions, said game comprising:

a. a game board having a playing surface and comprising:
  1) a center portion representing a goal to be achieved;
  2) a boundary area surrounding said center portion and comprising a plurality of:
    a) starting point spaces, each starting point space having a unique visual indicator; and
    b) movement spaces interspersed between said starting point spaces, each movement space bearing a visual indicator of an occupational education subject category; and
  3) at least one spoke area connecting said center space with said boundary area and comprising further movement spaces;

b. a plurality of individual game pieces, each game piece bearing a visual indicator that corresponds to the visual indicator of one of the starting point spaces;

c. a plurality of question and answer cards, each card bearing a visual indicator of an occupational education subject category corresponding to the visual indicator of one or more movement spaces;

d. a plurality of penalty cards;

e. a chance means for determining movement along said boundary area and spoke area; and f. a plurality of tokens to be awarded as each game piece reaches a starting point space;

said method comprising:

a. having a first player select a game piece and placing it upon a starting space;

b. activating said chance means to indicate the number of spaces said first player is to advance said game piece along the boundary area in any direction from the starting space;

c. advancing the game piece the number of spaces indicated by said chance means to a movement space;

d. selecting a question and answer card bearing a visual indicator that corresponds with the visual indicator of the movement space to which the game piece is advanced and asking the first player the question thereon;

e. timing said first player while he or she answers said question;

f. allowing the first player to play again if he or she answers correctly within a pre-selected time period and, he or she answers incorrectly, passing the chance means to the next player, unless the question card is marked as critical, wherein said first player is required to draw a penalty card and to perform the penalty described thereon;

g. continuing play through all players until at least one player has visited each starting point space and collected a token from each corresponding to the starting point space and has progressed up a spoke area to enter said central area.

12. The method of claim 11 wherein the center portion is circular, the boundary area is rectangular, and the spoke area connects the center area with either a starting point space or a movement space in the boundary area.

13. The method of claim 11 wherein each starting point space bears a visual indicator of a military fort in the United States of America.

14. The method of claim 11 wherein at least one of said visual indicators of said starting point spaces and said visual indicators of said movement spaces are color-coded.

15. The method of claim 11 wherein said boundary area also comprises a plurality of double play spaces interspersed among said starting point spaces and said movement spaces, wherein, if said first player moving the number of spaces indicated by said chance means ends with his or her game piece on a double play space, she or she may activate said chance means again without having to answer a question.

16. The method of claim 11 wherein said spoke area or boundary area comprises a special advance space, which indicates that a progressing game piece should "go to" a specified starting point space, wherein, if said first player moving the number of spaces indicated by said chance means ends with his or her game piece on a special advance space, he or she is required to return to the starting point space indicated.

17. The method of claim 11 wherein said question and answer cards bear a question regarding an aspect of military information relating to the corresponding occupational education subject category and the answer to the question, wherein a player rather than said first player draws said question and answer card, asks the questions, and limits the time allowed for the first player to answer the question correctly.

18. The method of claim 11 wherein said game board further comprises an area for the placement of penalty cards.

19. The method of claim 11 wherein said penalty cards indicate various penalties for incorrect answers to questions on said question and answer cards, wherein, if said first player is unable to answer said question within the preselected time period, and if the question is marked as critical, said first player is required to draw a penalty card and perform the specified penalty.

20. The method of claim 11 wherein said chance means is a die and is activated by release on an even surface.

* * * * *